US005939973A

United States Patent [19]

Imamura

[11] Patent Number: 5,939,973

[45] Date of Patent: Aug. 17, 1999

[54] ROTARY VARIABLE RESISTOR WITH SWITCH

[75] Inventor: Masao Imamura, Maebashi, Japan

[73] Assignee: Tubame Musen, Inc., Gunma, Japan

[21] Appl. No.: 09/158,509

[22] Filed: Sep. 22, 1998

[30] Foreign Application Priority Data

May 29, 1998 [JP] Japan ..... 10-149661

[51] Int. Cl.[6] ..... H01C 10/36

[52] U.S. Cl. ..... 338/172; 338/162; 338/167; 338/200; 338/196; 338/198

[58] Field of Search ..... 338/172, 173, 338/178, 179, 198, 200, 201, 170, 196, 78, 162, 163, 167

[56] References Cited

U.S. PATENT DOCUMENTS 2,724,758 11/1955 Brown ..... 338/167
2,884,505 4/1959 Strain ..... 338/196
3,312,925 4/1967 Frantz ..... 338/200

FOREIGN PATENT DOCUMENTS 846720 8/1952 Germany .
3800956 7/1989 Germany .

*Primary Examiner*—Michael L. Gellner
*Assistant Examiner*—Karl Easthom
*Attorney, Agent, or Firm*—Townsend & Banta

[57] ABSTRACT

A rotary variable resistor with switch having a switch mechanism, in particular, a rotary variable resistor with switch corresponding to an ultrathin rotary variable resistor. Such a rotary variable resistor having a switch mechanism has dimensions, especially thickness, which are only slightly larger than that of a conventional ultrathin rotary variable resistor. Moreover, such a rotary variable resistor is easy to assembly due to the small number of parts, is reliable, and generates a fairly loud and easily recognizable clicking sound each time the switch is turned on or off, which can be both easily felt and heard by the user.

3 Claims, 13 Drawing Sheets

ROTARY VARIABLE RESISTOR WITH SWITCH

FIELD OF THE INVENTION

The present invention relates to a rotary variable resistor with switch and, more particularly, to a variable resistor with switch corresponding to an ultrathin rotary variable resistor with an overall thickness of about 2 mm, which generates a clicking sound when the switch is turned on and off.

BACKGROUND OF THE INVENTION

A rotary variable resistor with switch is characterized by having two mechanisms, that is, the variable resistance mechanism for varying the resistance value, and the switch mechanism for electric contact and non-contact by on/off operation of the switch.

In a conventional rotary variable resistor with switch, the variable resistance mechanism and the switch mechanism are stacked in two layers, one atop the other, and the switch mechanism includes a spring (torsion coil spring, etc.) and a metal piece used as a contact. Hence, in general, due to the increased number of parts, the size of a conventional rotary variable resistor is somewhat larger than that of an ordinary rotary variable resistor (VR) having only a variable resistance mechanism. In addition, the assembly process is more complicated, and the manufacturing cost higher, than that of an ordinary rotary variable resistor (VR).

In the past, it has been very difficult to add a switch mechanism to a conventional ultrathin rotary variable resistor, as shown in FIG. 13, without both an increase in thickness and cost. Prior attempts to add a switch to a VR have involved attempting to fit a switch mechanism onto the back side of the ultrathin VR, but the complicated, more costly assembly procedure has always resulted in an increase in thickness.

Therefore, a simple switch mechanism applicable to a new ultrathin rotary variable resistor, having only a small in increase in the cost, number of parts and complexity of assembly process, has been desired. In addition, it is important that said switch mechanism have a knob which can be held and felt securely by a user and, when the switch is turned on or off, a clicking sound should be clearly discernible.

New small, thin electronic appliances, such as card radios, portable stereo cassette recorders, and electronic pulse massager's require ultrathin rotary variable resistors of less than 2 mm in thickness. Recently there is a mounting demand for adding a switch to such ultrathin rotary variable resistors, but at present, such ultrathin rotary variable resistors with a switch, as described above, have been unavailable.

SUMMARY OF THE INVENTION

The invention is devised in light of the above considerations, and it is an object thereof to provide a rotary variable resistor with switch having a novel switch mechanism. Such a rotary variable resistor with said switch mechanism has dimensions, especially thickness, which are only slightly larger than that of a conventional ultrathin rotary variable resistor. Moreover, such a rotary variable resistor is easy to assembly due to the small number of parts, is reliable, and generates a fairly loud and easily recognizable clicking sound each time the switch is turned on or off, which can be both easily felt and heard by the user.

In the first embodiment, a rotary variable resistor with switch is provided, comprising a resin substrate, a metal plate and a disk-shaped knob. The resin substrate comprises a top surface, a bottom surface and periphery, the top surface having a resistance element and a conductor formed concentrically thereon, which are connected electrically to plural terminals disposed in the periphery of the resin substrate. A small hole is formed through the resin substrate in a position apart from the resistance element, conductor and plural terminals. A metal plate abuts against the bottom surface of the resin substrate. One portion of the metal plate, which corresponds to the position of the small hole formed through said resin substrate, is deformed elastically towards the bottom surface of the resin substrate. A spherule is provided having a diameter smaller than said small hole and larger than the thickness of the resin substrate, the spherule being disposed in the small hole formed in the resin substrate.

The disk-shaped knob of the above embodiment, which slidably abuts against the resistance element or conductor of the resin substrate described above, comprises a top surface, a bottom surface, a center z and a knob peripheral area having two recesses. Two slider brushes for variable resistance and mutually insulated switching are disposed on the bottom surface of the disk-shaped knob to contact the resistance element and conductor formed on the top surface of the resin substrate, and the center z of the disk-shaped knob rotatably pivots on the top surface of the resin substrate. Two adjacent recesses are disposed in the knob peripheral area of the disk-shaped knob corresponding to the position of the small hole formed in the resin substrate at the rotation stop position of the knob, the first recess forming a rectangular recess and the second recess having a wedge-shaped section containing a slope.

As the disk-shaped knob is rotated to the rotation stop position, or rotated in the opposite direction of the rotation stop position, the spherule disposed in the small hole in the resin substrate is thrust against the bottom surface of the disk-shaped knob by the elastic force exerted by the metal plate, and as the disk-shaped knob is turned, the spherule is pushed in twice, successively, into the two recesses of the disk-shaped knob.

In the second embodiment, a rotary variable resistor with switch is provided, comprising a resin substrate, a metal plate and a disk-shaped knob. The resin substrate comprises a top surface, bottom surface and periphery, the top surface having a resistance element and a conductor formed concentrically thereon, which are connected electrically to plural terminals disposed in the periphery of the resin substrate. A small hole is formed through the resin substrate in a position apart from the resistance element, conductor and plural terminals. A metal plate abuts against the bottom surface of the resin substrate. One portion of this metal plate, which corresponds to the position of the small hole formed through said resin substrate, is deformed elastically towards the bottom surface of the resin substrate. A protruding portion, also referred to as a dowel, having a nearly spherical head, is planted in the elastically deformed portion of the metal plate and protrudes through the small hole formed in the resin substrate.

The disk-shaped knob of the above embodiment, which slidably abuts against the resistance element or conductor of the resin substrate described above, comprises a top surface, a bottom surface, a center z and a knob peripheral area having two recesses. Two slider brushes for variable resistance and mutually insulated switching are disposed on the bottom surface of the disk-shaped knob to contact the resistance element and conductor formed on the top surface of the resin substrate, and the center z rotatably pivots on the top surface of the resin substrate. Two adjacent recesses are disposed in the knob peripheral area of the disk-shaped knob corresponding to the position of the small hole formed in the resin substrate at the rotation stop position of the knob, the first recess forming a rectangular recess and the second recess having a wedge-shaped section containing a slope. The protruding portion, or dowel, planted in the metal plate abuts against the bottom surface of the disk-shaped knob by protruding through the small hole formed in the resin substrate.

As the disk-shaped knob is rotated to the rotation stop position, or rotated in the opposite direction of the rotation stop position, the protruding piece of the metal plate, which protrudes through the small hole of the resin substrate, is thrust against the bottom surface of the disk-shaped knob by the elastic force exerted by the metal plate, and as the disk-shaped knob is turned, the protruding piece planted in the metal plate is pushed in twice, successively, into the two recesses of the disk-shaped knob.

In a third embodiment, a rotary variable resistor with switch is provided which is similar to that provided in the second embodiment described above. However, in this embodiment, the protruding piece is planted loosely in the elastically deformed portion of the metal plate, with a movable range of play in the elastically deformed portion of the metal plate.

Thus, by disposing two adjacent recesses in the peripheral area of the disk-shaped knob, when rotating the disk-shaped knob, the spherule disposed in the small hole in the resin substrate (the spherule itself is almost entirely fitted in the small hole and defined in motion in longitudinal and lateral direction, and held in vertical direction between the metal plate and the disk-shaped knob) or the nearly spherical head of the protruding piece planted in the metal plate rides over the step difference of the recesses, which generates a clicking sound. This clicking sound is generated once every time the disk-shaped knob is rotated in the clockwise direction and counterclockwise direction, that is, every time the switch is turned on or off.

DETAILED DESCRIPTION OF THE INVENTION

Figure 13:
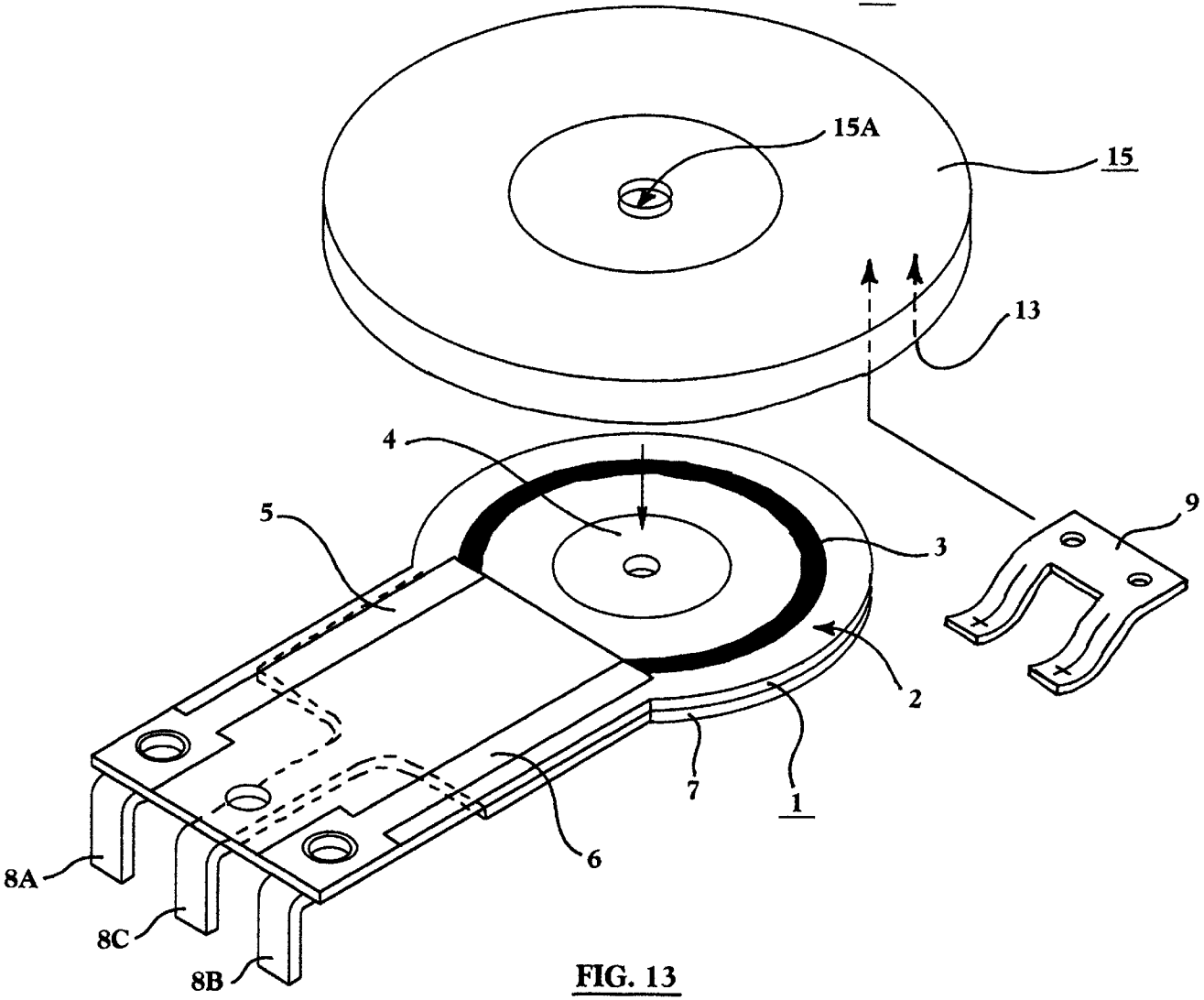
FIG. 13 is an exploded perspective view of a conventional ultrathin rotary variable resistor.

A conventional ultrathin rotary variable resistor is shown in a perspective exploded view in FIG. 13, in which resistance ink mixing carbon powder as resistance material, liquid phenol resin as binder, and solvent is applied and printed on a top surface 2 of a resin substrate 1 to form a specific shape. For example, in FIG. 13 a concentric resistance element 3 is shown having an angle of rotation of 300 degrees. A conductor 4 is similarly printed concentrically.

In this conventional ultrathin rotary variable resistor, both ends of the resistance element 3 are connected to terminals 8A, 8B which lead out from printed conductors 5, 6 made of silver paint or the like. The conductor 4 is electrically connected to a connection terminal 8C, which is formed in the end of a metal plate 7. This metal plate 7 has the same shape as the resin substrate 1, and is disposed underneath the resin substrate to form a base upon which to compose the resin substrate 1, for example, a phenol laminate substrate.

A disk-shaped knob 15, having a bottom surface 13 upon which a slider brush 9 is dispose, pivoting about its center 15A, is rotatably disposed atop the top surface 2 of the resin substrate 1. The disk-shaped knob 15 slidably rotatably abuts against the resistance element 3 and conductor 4 of the resin substrate. Such an ultrathin rotary variable resistor 20 typically has an overall thickness of 1.7 to 1.9 mm, with a disk-shaped knob having a diameter of about 12 mm.

At the present, in addition to the above described structure, a twin ultrathin rotary variable resistor has been developed, which has two slider brushes which contact plural concentric resistance elements.

Figure 1:
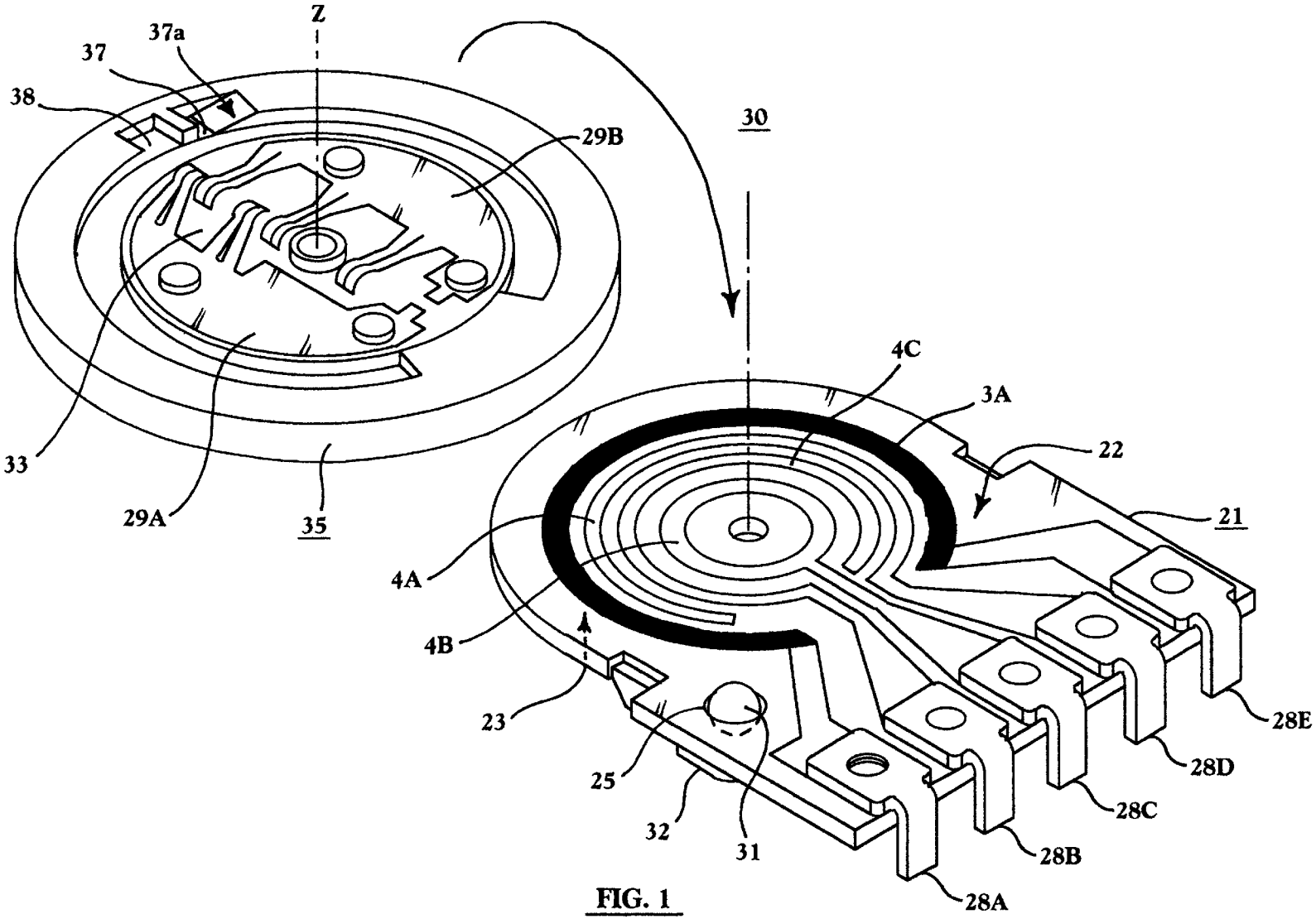
FIG. 1 is an exploded perspective view of the rotary variable resistor with switch of the first embodiment of the present invention, metal plate not being shown in detail.
Figure 4:
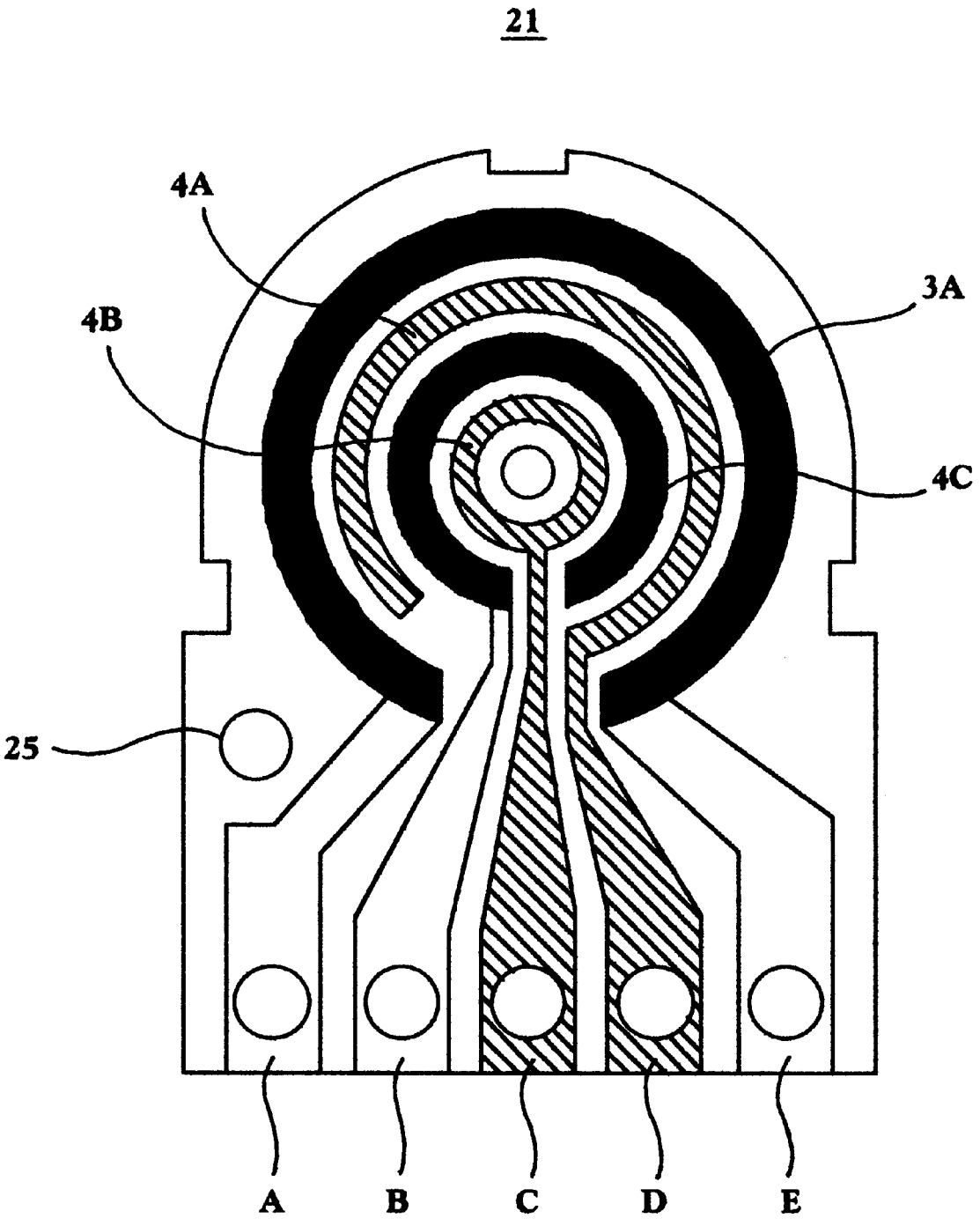
FIG. 4 is a plan view of the top surface of the resin substrate of the rotary variable resistor with switch of the invention (before fitting the terminals) of the first embodiment of the present invention.

FIGS. 1–5 show a rotary variable resistor with switch 30 which comprises a resin substrate 21, a disk-shaped knob 35, a metal plate 32 and a spherule 31. The resin substrate 21 has a top surface 22, a bottom surface 23 and a periphery. A resistance element 3A and conductors 4A, 4B and/or 4C are formed concentrically on the top surface 22 of the resin substrate 21 and connected electrically to plural terminals 28A to 28E disposed in the periphery of the resin substrate. As shown in FIGS. 1 and 4, a small hole 25 is formed through said resin substrate 21 in a position apart from the resistance element 3A, conductors 4A, 4B and 4C and plural terminals 28A to 28E.

The resin substrate 21 is made of glass epoxy resin or phenol resin. The resin substrate 21 is approximately 14 mm in length, 11 mm in width, and 0.4 mm in thickness. As shown in FIG. 4, the resistance element 3A and conductors 4A, 4B, 4C are printed, for example, by screen printing of silver ink, and then formed concentrically by plating means, or by the same means as when forming a copper foil as in a printed circuit board. The resistance element 3A and conductor 4C are connected to a conductor at their ends, while the conductors 4A, 4B are directly extended and lead to the periphery.

The disk-shaped knob 35 has a bottom surface 33, a top surface opposite said bottom surface 33, a center z, and a knob peripheral area having two recesses 37, 38. Two slider brushes 29A, 29B for variable resistance and mutually insulated switching are disposed on the bottom surface 33. The bottom surface 33 of the disk-shaped knob 35 slidably abuts against the resistance element 3A and conductor 4C formed on the top surface 22 of the resin substrate 21, and pivots rotatably on center z on the top surface 22 of the resin substrate 21. The two adjacent recesses 37, 38 are disposed in the knob peripheral area of the disk-shaped knob 35 corresponding to the position of the small hole 25 formed in the resin substrate 21 at the rotation stop position of the knob, the first recess 38 forming a rectangular recess and the second recess 37 having a wedge-shaped section containing a slope 37A.

The disk-shaped knob 35 is made of resin, is approximately 14 mm in diameter and 0.9 mm in thickness in the peripheral part, and the periphery of the knob is milled in 60 to 80 threads. The recesses 37, 38 disposed in the peripheral area of the knob are approximately 0.3 mm in depth and 1 to 2 mm in length.

Figure 2:
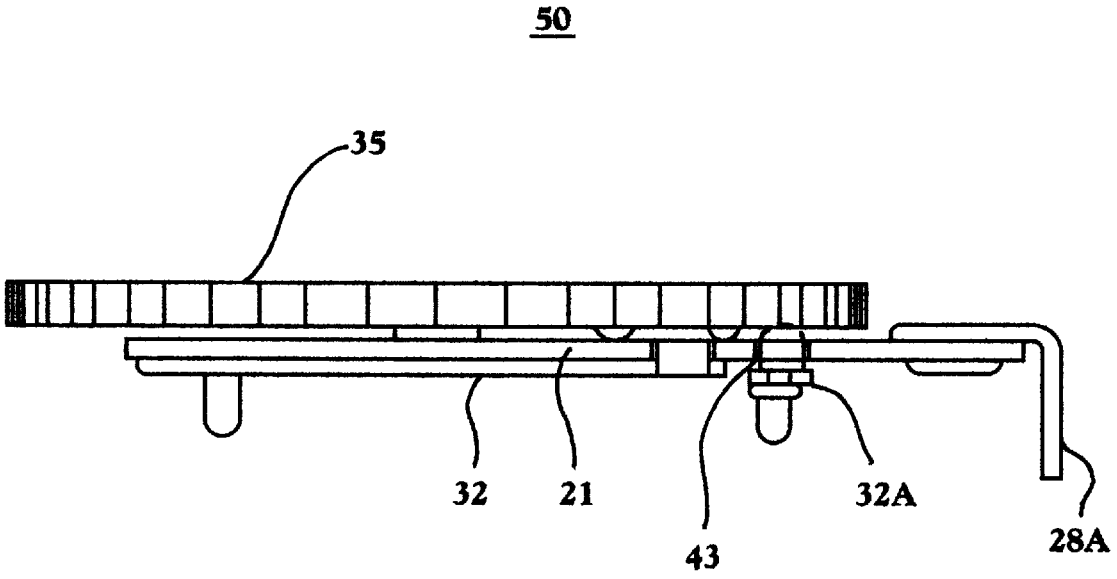
FIG. 2 is a side view of the rotary variable resistor with switch, as shown in FIGS. 1(*a*) and 1(*b*), of the first embodiment of the present invention.
Figure 3:
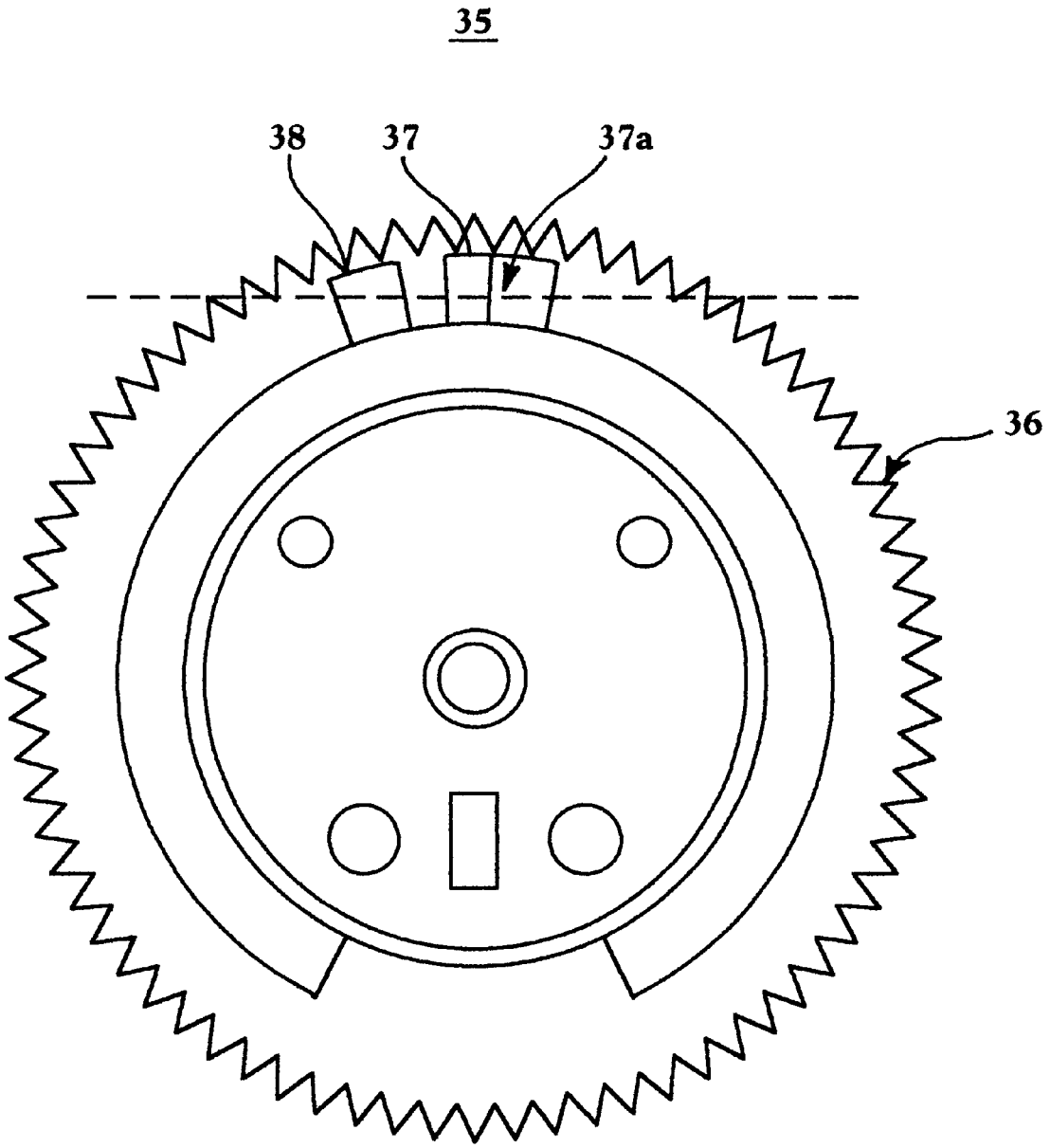
FIG. 3 is a plan view of the bottom surface of the disk-shaped knob, which confronting the resin substrate of the knob used in the rotary variable resistor with switch of the invention.
Figure 5:
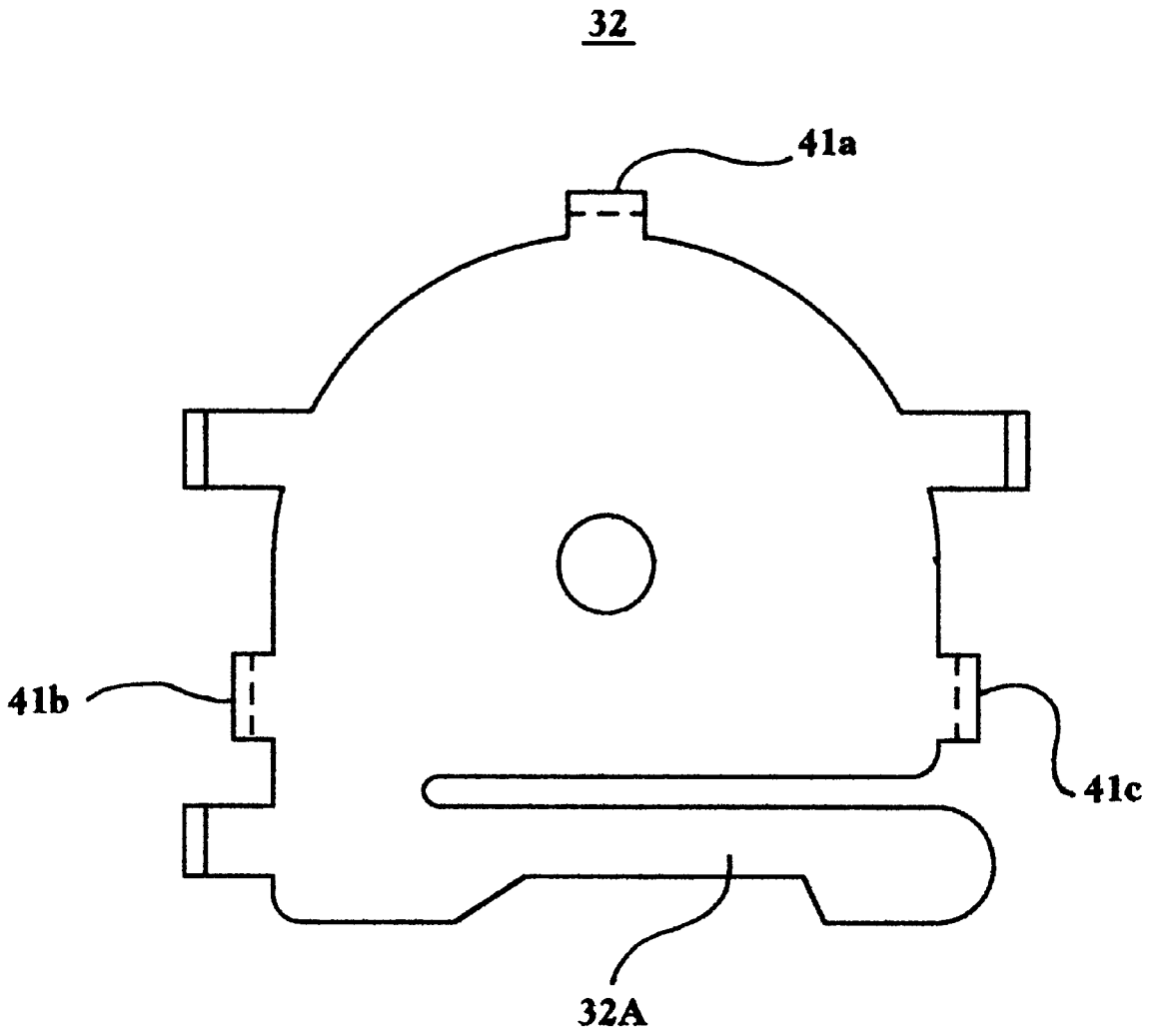
FIG. 5 is a plan view of the metal plate of the rotary variable resistor with switch of the first embodiment of the present invention.

A metal plate 32, as shown in FIGS. 1, 2 and 5, abuts against the bottom surface 23 of the resin substrate 21, and has one portion corresponding to the position of the small hole 25 formed in the resin substrate 21 deformed elastically in the direction of the resin substrate 21. A spherule 31 is provided having a diameter smaller than small hole 25 formed in the resin substrate 21 and larger than the thickness of the resin substrate 21. As the knob 35 is rotated to the rotation stop position or rotated in the opposite direction of the rotation stop position, the spherule 31 disposed in small hole 25 in the resin substrate 21 is thrust against the bottom surface 33 of the knob 35 by the elastic force exerted by the elastically deformed portion of metal plate 32, and is pushed in twice, successively, into the two recesses 37, 38.

At the rotation stop position of knob 35, the spherule 31 is positioned immediately beneath the recess 38, and is partially thrust into the recess 38 by the metal plate 32. At this time, the slider brush 29B, used for switching on and off, is moved to position x, as shown in FIG. 1. Terminals 28C and 28D are in a non-conducting state, i.e., off state.

Such a rotary variable resistor with switch 30 is approximately 17 mm in maximum length, 14 mm in width, and 1.8 mm in thickness H, therefore being classified as an ultrathin or ultrasmall type rotary variable resistor. The overall dimensions of such a rotary variable resistor with switch are hardly increased (substantially no increase) as compared to a conventional rotary variable resistor 20 without switch, as shown in FIG. 13.

The metal plate 32, as shown in FIG. 5, is a so-called shield plate, having slight elasticity in a flat shape. The metal plate 32 has a thickness of about 0.3 mm, and is fitted to the resin substrate 21 through protrusions 41*a*–41*c* disposed in the periphery. An elastically deformed portion 32A corresponding to the position of the small hole 25 in the resin substrate 21 is extended like an arm, having a spring property provided by its own elasticity, so that it is designed to deform elastically towards the resin substrate 21. This elastically deformed portion 32A exerts an elastic force in the direction of the resin substrate so as to press the spherule 31 into the small hole 25 formed through resin substrate 21.

The spherule 31 is preferably a chrome-plated steel ball having a diameter of about 1 mm. However, any rigid ball excellent in durability and capable of generating a clicking sound may be used, for example, a ceramic ball.

The slider brushes 29A, 29B of disk-shaped knob 35 are metal foils of about 0.1 mm in thickness and are fitted and fixed on the bottom surface 33 of the disk-shaped knob 35. Said sliders are formed by a press into a folded shape so that the brush end acting as the contact may contact with the resistance element 3A or conductors 4A–4C at an appropriate pressure.

Figure 6:
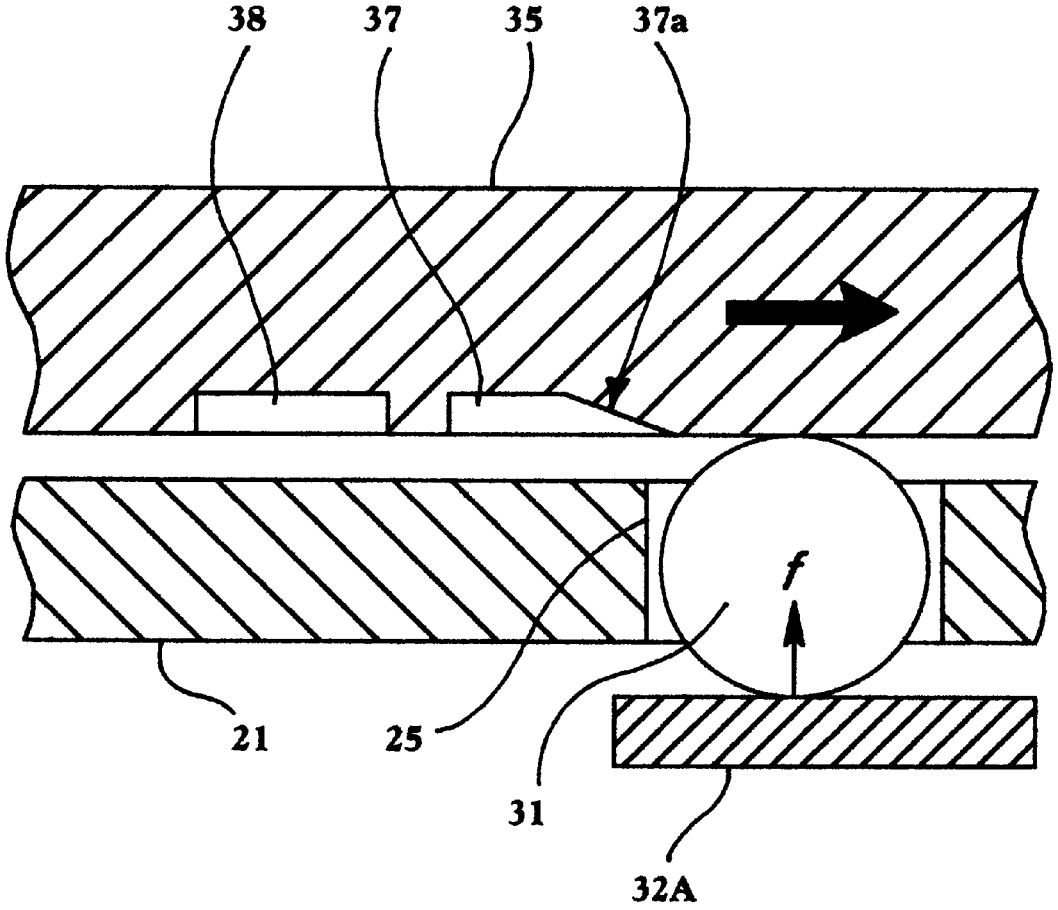
FIG. 6 is a partial cut away side view of the rotary variable resistor with switch of the first embodiment, showing the relation of the disk-shaped knob with the resin substrate, spherule, and elastically deformed portion of the metal plate during the time the switch is being turned toward the ON state.
Figure 7:
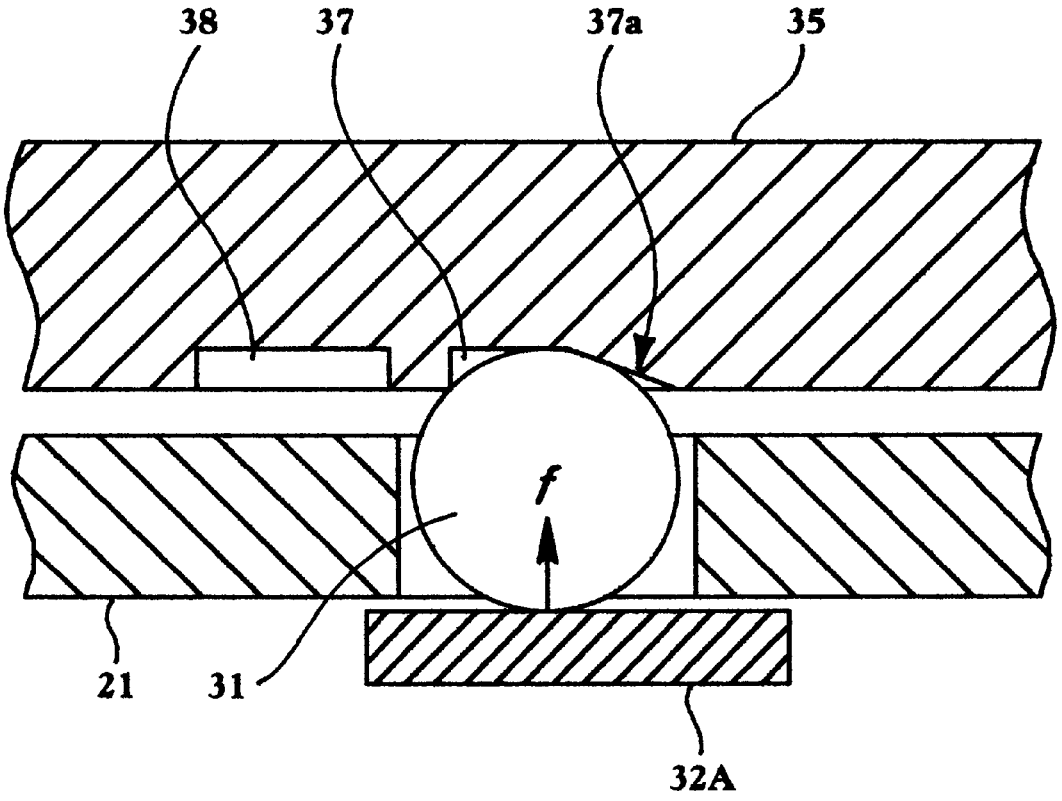
FIG. 7 is a partial cut away side view of the rotary variable resistor with switch of the first embodiment, showing the state of the spherule after it is pushed into the wedge-shaped recess of the disk-shaped knob, and henceforth the ON state.
Figure 8:
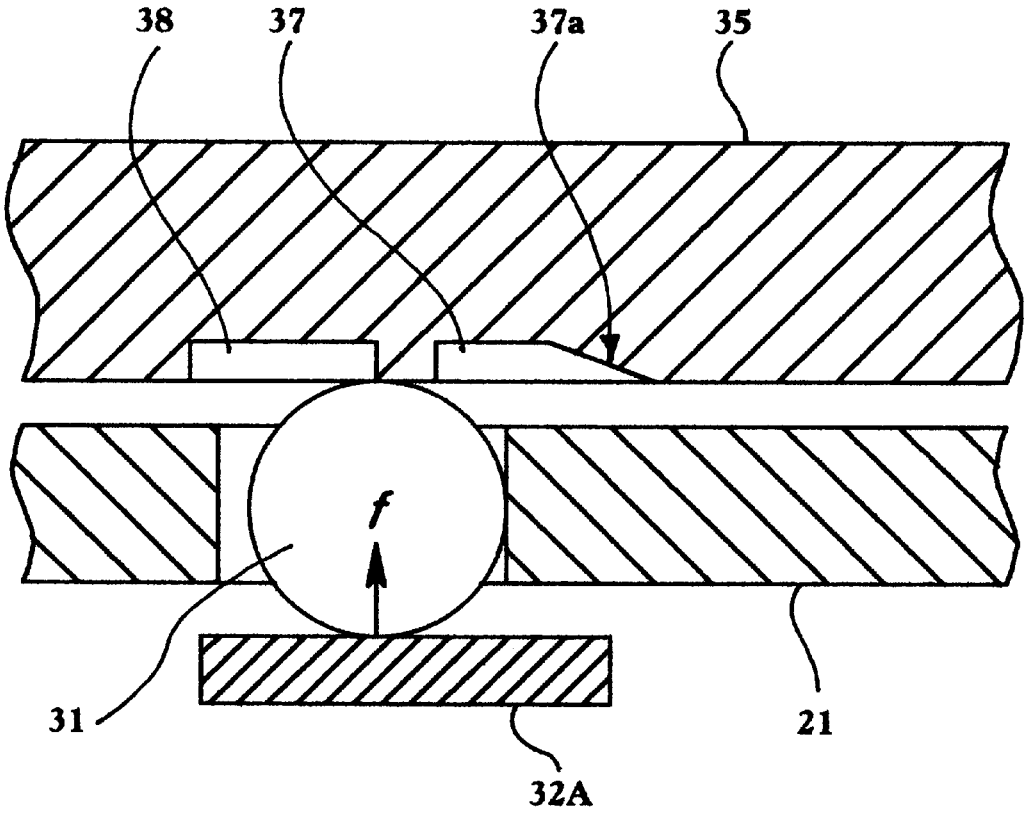
FIG. 8 is a partial cut away side view of the rotary variable resistor with switch of the first embodiment, showing the state of the spherule immediately before generation of the clicking sound.
Figure 9:
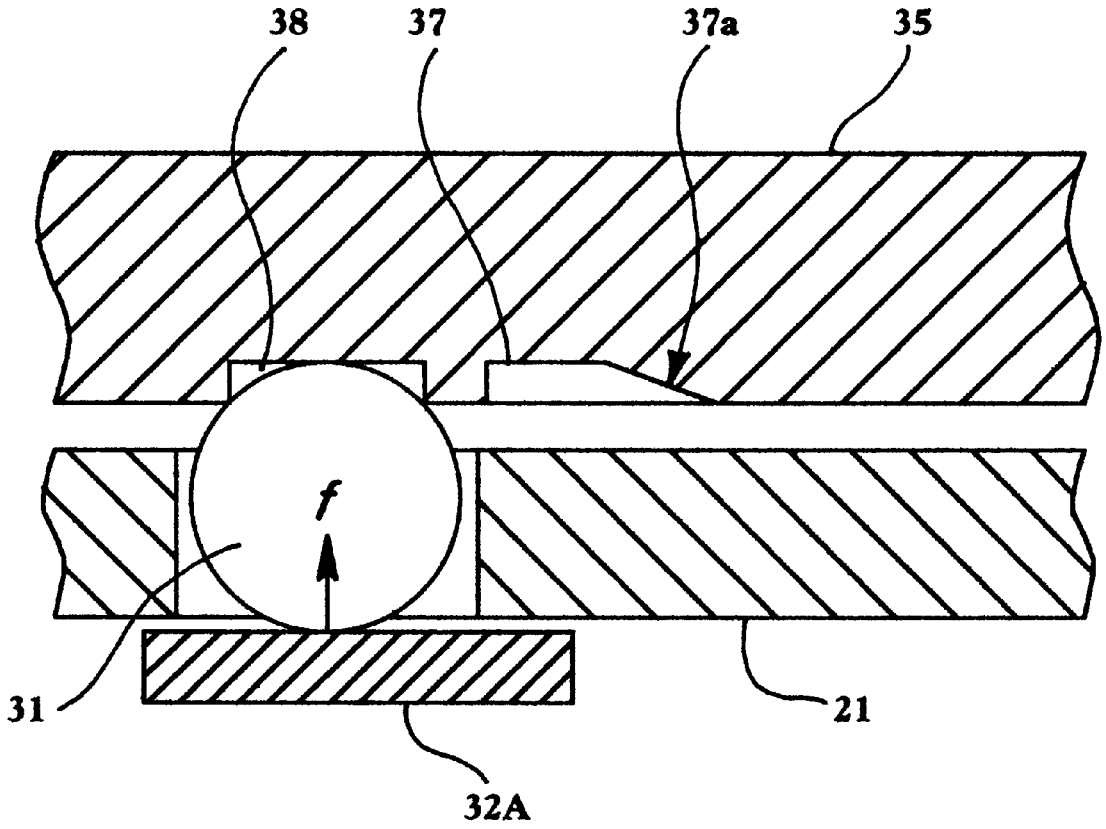
FIG. 9 is a partially cut away side view of the rotary variable resistor with switch of the first embodiment, showing the state of the spherule when said rotary variable resistor with switch is in the OFF state.

As shown in FIG. 6, the recess 38 of the disk-shaped knob 35 has a rectangular section, for example, composed of a simple vertical surface, and the recess 37 has a wedge-shaped section having a slope 37*a*. When the knob 35 is rotated in the thick arrow direction (the direction from on state to off state), as shown in FIG. 6, first the spherule 31 is thrust and pushed into and along slope 37*a* and into the recess 37 by the elastic force f of the elastically deformed portion 32A of the metal plate, as shown in FIG. 7. Then, as shown in FIG. 8, when the knob is successively turned in the arrow direction, the spherule 31 comes out of the recess 37, and is pushed into the next recess 38, as shown in FIG. 9, thereby generating a clicking sound. When turned reversely from the rotation stop position as shown in FIG. 9, at which time the spherule 31 is pushed in the recess 38 and the switch is turned off, the spherule 31 comes out of the recess 38 and is pushed into the recess 37, thereby generating a clicking sound. In this way, since the two recesses 37, 38 are disposed adjacently, a clicking sound is generated each time the switch is turned from OFF to ON, and from ON to OFF.

However, if there were only one recess, although a clicking sound would be generated when switching from ON to OFF, when switching from OFF to ON, the spherule 31 would only come out of the recess and not be thrust into another recess. This action would not generate a clicking sound. When there are two recesses, as in the present invention, if the spherule 31 only rolls up or down on the slope 37A, a clicking sound is not generated.

Thus, by forming a wedge-shaped section in one recess 37 , the reaction of the spherule may be felt by a user and an adequate single clicking sound can be obtained. Therefore, reliable, secure on/off switching operation is obtained. However, the configuration of the recesses 37, 38 is determined simply by the setting position of the switch and the rotating direction of the knob, and the recess 37 refers to the recess in which the spherule 31 is pushed in first when changing from ON state to OFF state.

In order to obtain smooth rotation of the disk-shaped knob and a recognizable switching action easily felt by a user while generating a clicking sound of an appropriate sound volume, the depth of the recesses 37, 38 is preferred to be 0.5 to 0.7 times the radius of the spherule 31. Therefore, it is essential that the depth of the recesses 37, 38 be smaller than the radius of the spherule 31. In this embodiment, the radius of the spherule 32 is about 0.5 mm, and the depth is set at about 0.3 mm.

Figure 10:
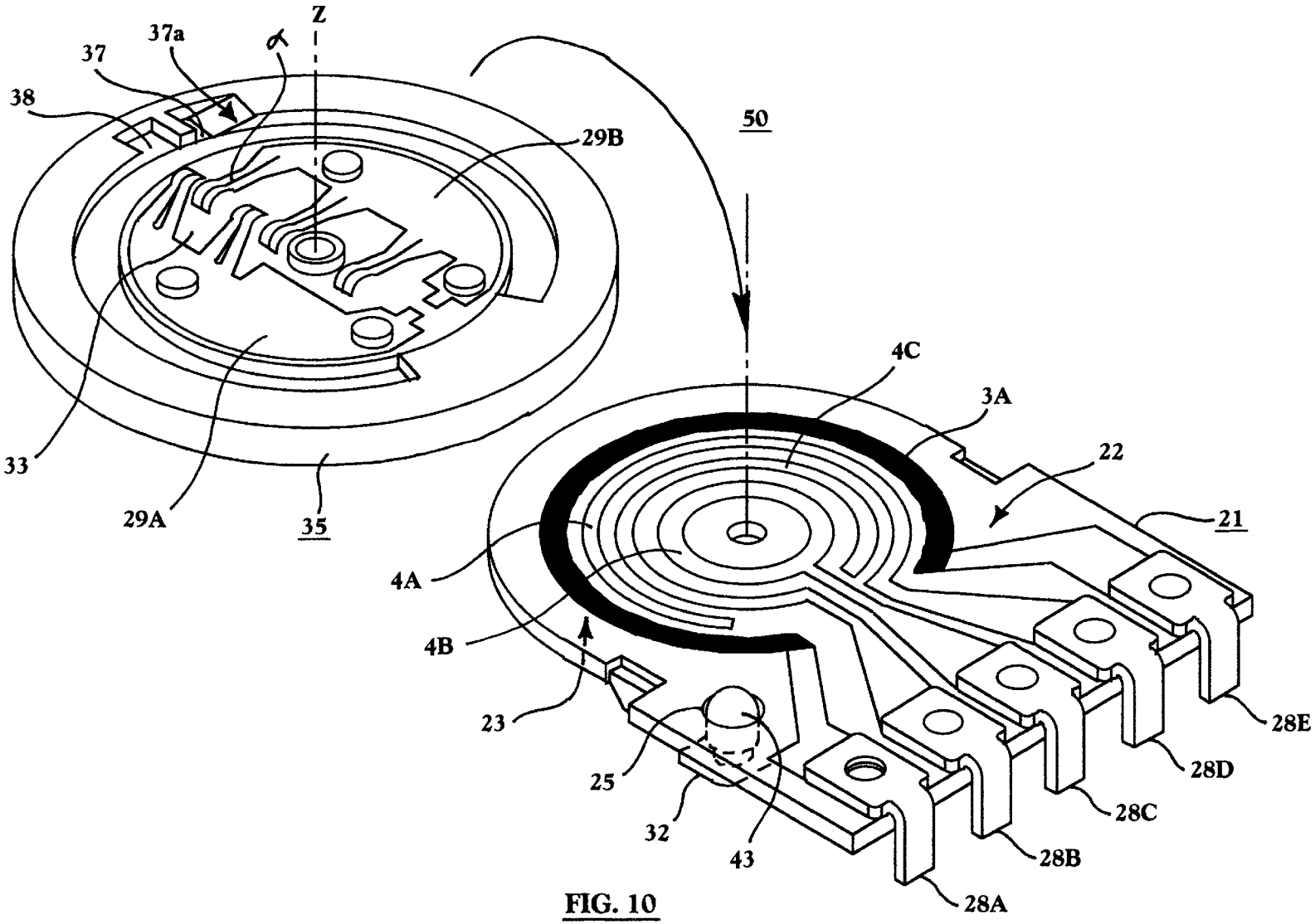
FIG. 10 is an exploded perspective view of the rotary variable resistor with switch of embodiments two or three of the present invention, the metal plate not being shown in detail.
Figure 11:
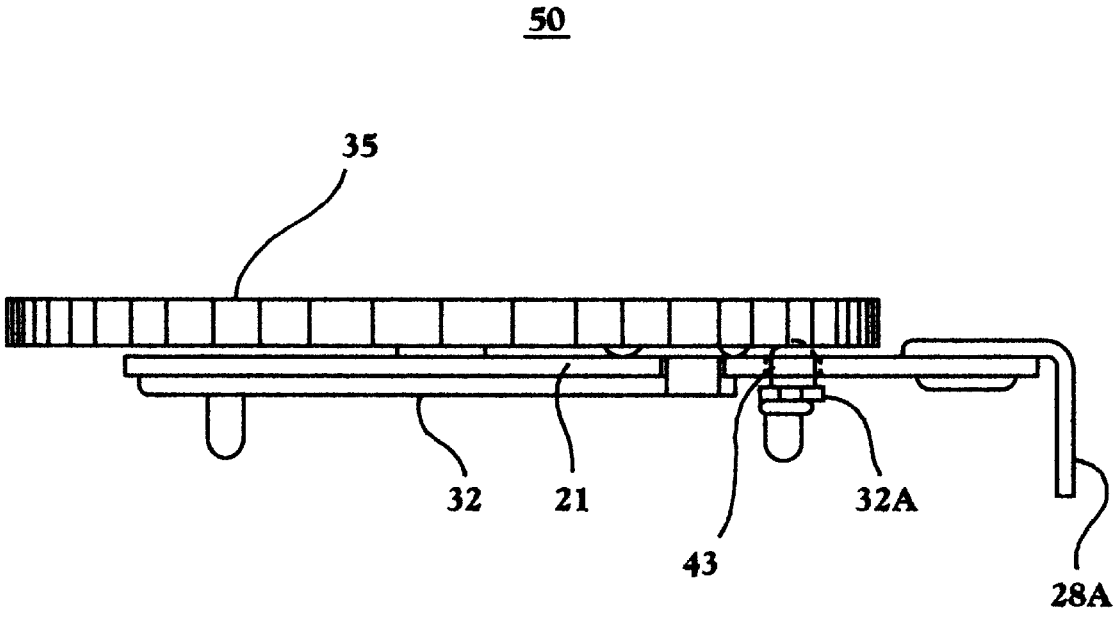
FIG. 11 is a side view of the rotary variable resistor with switch of embodiments two and three.
Figure 12:
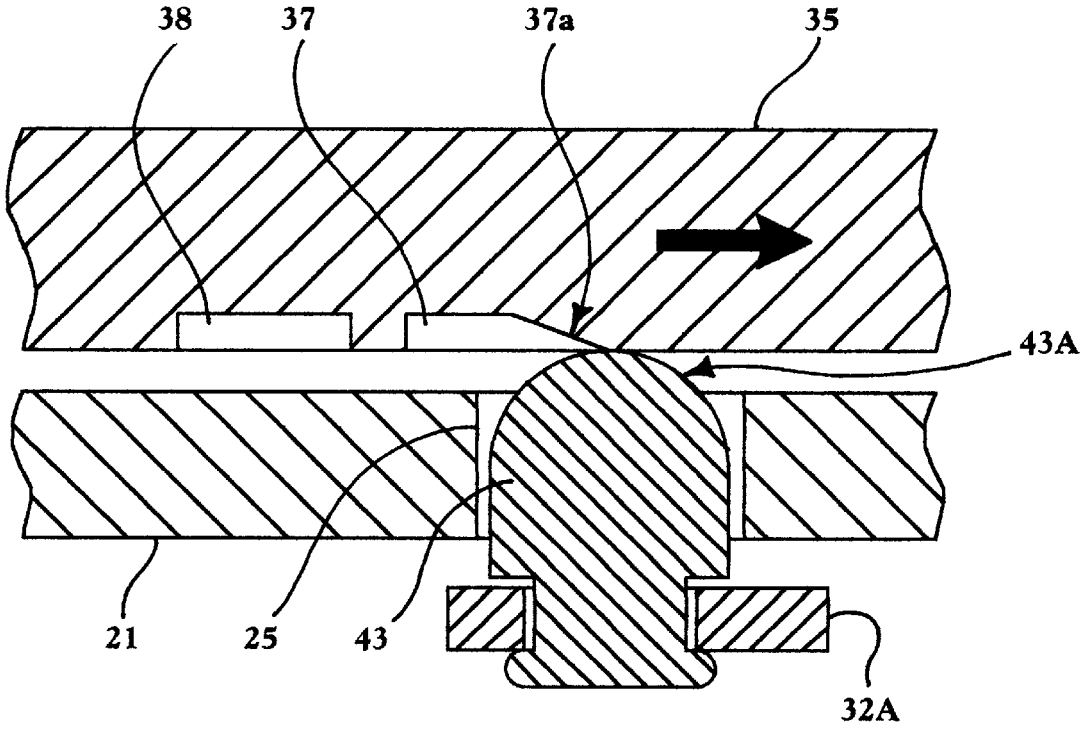
FIG. 12 is a partial cut away side view of the rotary variable resistor with switch of the second and third embodiments of the present invention, showing the relation of the disk-shaped knob with the resin substrate, spherule, and the elastically deformed portion of the metal plate.

As shown in FIGS. 10–12, which illustrate embodiments 2 and 3 of the present invention, a rotary variable resistor with switch 50 is provided which is very similar to the rotary variable resistor with switch 30 described above, except that, in place of spherule 31, a protruding piece 43, also referred to as a dowel, having a nearly spherical head 43A and abutting against the bottom surface 33 of the disk-shaped knob 35 through the small hole 25 in the resin substrate 21, is planted so as not to be displaced in the elastically deformed portion 32A of the metal plate 32 by crimping from the back side of the metal plate 32. And, with the spherule 31 in the preceding rotary variable resistor with switch 30, the protruding piece 43 is thrust against the bottom surface 33 of the disk-shaped knob 35 by the elastically deformed portion 32A of the metal plate 32. When the rotary variable resistor with switch 50 is used, the protruding piece 43 is pushed in twice, successively, into the two recesses 37, 38.

In the rotary variable resistor with switch 50, as set forth in embodiment 3 of the present invention, in addition to the above, the protruding piece 43 is planted loosely with a movable range of play in the elastically deformed portion 32A of the metal plate 32. The protruding piece 43 is made of, for example, a rigid synthetic resin or metal, and its nearly spherical head 43A has the same effect and action as the spherule 31 for generating a clicking sound.

As for the switch of embodiments 2 and 3, as shown in FIG. 12, when the knob 35 is turned in the direction of the thick arrow to switch from the ON state to the OFF state, first the nearly spherical head 43A of the protruding piece 43 is pushed into the recess 37, but at this time, since it rolls on the tapered slope 37*a*, a clicking sound is not generated. But, when the protruding piece 43 is pushed into the next recess 38, a clicking sound is generated. When the switch is turned from OFF to ON, the protruding piece 43 pushed into the recess 38 is pushed out of the recess 38, and is immediately and abruptly forced into the wedge-shaped section of the recess 37, thereby generating a single clicking sound.

The rotary variable resistor with switch 50 of the present invention is superior to the conventional rotary variable resistor with switch 20, particularly, in that the reliability is notably enhanced a larger, more distinctive clicking sound is obtained.

More specifically, in the rotary variable resistor with switch 30, the spherule 31 is independent, and is merely held in place between the knob 35 and metal plate 32 in the small hole 25 of the resin substrate 21, and the spherule 31 may be dislocated from the gap during use due to thermal deformation of the knob or shock. Therefore, utmost caution was required in the handling of this tiny spherule 31 during assembly. By contrast, in the rotary variable resistor with switch 50 wherein protruding piece 43 is planted in the elastically deformed portion 32A of metal plate 32, the nearly spherical head 43A of the protruding piece 43 acts in the same manner as the spherule 31, and moreover, since it is planted at a specified position on the elastically deformed portion 32A, it cannot be dislocated. Besides, planting of the protruding piece 43 by crimping onto the elastically deformed portion 32A of the metal plate 32 does not rigidly affix the protruding piece in place, but rather it is planted loosely on metal plate 32 with a movable range of play, so that the nearly spherical head 43A of the protruding piece 43 may move somewhat in the longitudinal and lateral direction, and therefore, owing also to the greater mass of the protruding piece 43 than the spherule 31, a more definite sense of switching on and off, and a larger clicking sound than in the case of the spherule 31 can be obtained.

The overall dimensions and shapes of the rotary variable resistors with switch 30 and 50, and dimensions and shapes of all various components may be adjusted to fit various designs, and should not be limited to the above illustrated embodiments.

As described herein, in the rotary variable resistor with switch of the present invention, the switch mechanism, in particular, is suited use in ultrathin and small size device, and undoubtedly, in the future, the present invention will prove very useful for use as the switch mechanism in ultrathin rotary variable resistors.

REFERENCE NUMERALS

1, 21 Resin substrate
3, 3A Resistance elements
4A, 4B, 4C Conductor
8A . . . , 28A . . . Terminals
9, 29A, 29B Slider Brushes
15, 35 Disk-shaped knob
20 Ultrathin rotary variable resistor
25 Small hole
30, 50 Rotary variable resistor with switch
31 Spherule
32 Metal plate
32A Elastically deformed portion
37, 38 Recess
37A Slope
43 Protruding piece (dowel)
43A Nearly spherical head

What is claimed is:

1. A rotary variable resistor with switch comprising a resin substrate in a structure having a resistance element and a conductor formed concentrically on one principal surface and connected electrically to plural terminals disposed in the periphery, and having a small hole opened in a specified position, a disk-shaped knob having two slider brushes for variable resistance and switch mutually insulated, sliding, while abutting against the resistance element or conductor of said resin substrate, disposed on a principal surface of the resin substrate side, and having the center pivoted rotatably on one principal surface of said resin substrate, a metal plate in a structure abutting against other principal surface of said resin substrate, and having one portion corresponding to the position of said small hole deformed elastically in the direction of the resin substrate, and a spherule having the diameter smaller than the small hole disposed in the small hole in the resin substrate and larger than the thickness of the resin substrate, wherein two adjacent recesses consisting of a rectangular cross-sectional recess and a wedge-shaped cross-sectional recess having a sloped section are disposed in the knob peripheral area corresponding to the position of the small hole in the said resin substrate at the rotation stop position of said knob, and as said knob is rotated to the rotation stop position or rotated from the rotation stop position into the opposite direction, the spherule disposed in the small hole in said resin substrate is thrust to the knob side by said metal plate and is pushed in twice successively into said two recesses.

2. A rotary variable resistor with switch comprising a resin substrate in a structure having a resistance element and a conductor formed concentrically on one principal surface and connected electrically to plural terminals disposed in the periphery, and having a small hole opened in a specified position, a disk-shaped knob having two slider brushes for variable resistance and switch mutually insulated, sliding while abutting against the resistance element or conductor of said resin substrate, disposed on a principal surface of the resin substrate side, and having the center pivoted rotatably on one principal surface of said resin substrate, a metal plate in a structure abutting against other principal surface of said resin substrate, and having one portion corresponding to the position of said small hole deformed elastically in the direction of the resin substrate, and a protruding piece having a nearly spherical head portion planted in the elastically deformed portion of said metal plate and abutting against the back side of said knob through the small hole in said resin substrate, wherein two adjacent recesses consisting of a rectangular cross-sectional recess and a wedge-shaped cross-sectional recess having a sloped section are disposed in the knob peripheral area corresponding to the position of the small hole in the said resin substrate at the rotation stop position of said knob, and as said knob is rotated to the rotation stop position or rotated from the rotation stop position into the opposite direction, said protruding piece is thrust to the back side of the knob side by said metal plate through the small hole in said resin substrate and is pushed in twice successively into said two recesses.

3. A rotary variable resistor with switch of claim 2, wherein said protruding piece is planted loosely with a movable range of play in the elastically deformed portion of said metal plate.

* * * * *